US005824925A

United States Patent [19]

Yost

[11] Patent Number: 5,824,925

[45] Date of Patent: Oct. 20, 1998

[54] TREMOLO AND/OR VIBRATO CONTROL SYSTEM, AND METHODS OF CONSTRUCTING AND UTILIZING SAME

[76] Inventor: John A. Yost, P.O. Box 91, 8888 Jordan Rd., Cleves, Ohio 45002

[21] Appl. No.: 569,569

[22] Filed: Dec. 8, 1995

[51] Int. Cl.[6] ..... G10D 3/00

[52] U.S. Cl. ..... 84/313; 84/298

[58] Field of Search ..... 84/313, 312 R, 84/298, 307

[56] References Cited

U.S. PATENT DOCUMENTS

| | | | |
|---|---|---|---|
| 1,750,325 | 3/1930 | Mills | 84/11 |
| 2,136,627 | 6/1938 | Lohman | 84/313 |
| 2,949,806 | 9/1960 | Turman | 84/297 |
| 3,382,749 | 5/1968 | Watson | 84/313 |
| 3,512,443 | 5/1970 | Parson et al. | 84/313 |
| 3,580,124 | 5/1971 | Mancini | 84/313 |
| 4,171,661 | 10/1979 | Rose | 84/313 |
| 4,343,220 | 8/1982 | Lundquist | 84/313 |
| 4,497,236 | 2/1985 | Rose | 84/298 |
| 4,512,232 | 4/1985 | Schaller | 84/313 |
| 4,643,070 | 2/1987 | Petrillo | 84/313 |
| 4,686,883 | 8/1987 | Piche et al. | 84/313 |
| 4,724,737 | 2/1988 | Fender | 84/313 |
| 4,903,568 | 2/1990 | Itoh | 84/313 |
| 4,928,564 | 5/1990 | Borisoff et al. | 84/313 |
| 4,939,971 | 7/1990 | Satoh | 84/313 |
| 4,941,384 | 7/1990 | Jäger | 84/313 |
| 4,944,208 | 7/1990 | Kusek | 84/313 |
| 5,277,094 | 1/1994 | Spuler | 84/298 |
| 5,311,804 | 5/1994 | Wilkinson | 84/313 |
| 5,392,680 | 2/1995 | Stets | 84/313 |
| 5,438,902 | 8/1995 | Baker | 84/312 R |

OTHER PUBLICATIONS

Tom Wheeler, American Guitars, 1992, New York, pp. 159–160.

*Primary Examiner*—Michael L. Gellner
*Assistant Examiner*—Shih-yung Hsieh
*Attorney, Agent, or Firm*—William F. Esser; William D. Blackman

[57] ABSTRACT

A tremolo system for a stringed musical instrument, comprising an arm member rotatably connected to the instrument body; a first fluid member, operatively connected to the arm member, for moving a bridge of the instrument in response to rotation of the arm member so as to change a pitch of a tone generated by the instrument; and a mechanism for rotating the arm member relative to the instrument so that rotation of the arm member in a first direction substantially raises a pitch of a tone generated by the instrument, and rotating the arm member in a second direction substantially lowers the pitch of a tone generated by the instrument.

29 Claims, 4 Drawing Sheets

TREMOLO AND/OR VIBRATO CONTROL SYSTEM, AND METHODS OF CONSTRUCTING AND UTILIZING SAME

BACKGROUND OF THE INVENTION

1. Field of Invention

This invention pertains to a system for controlling the vibrato effect of a stringed musical instrument, such as a guitar, and in particular to a device which controls the movement of the instrument bridge in response to manual movements of the instrument's tremolo arm.

2. Description of the Relevant Art

There are known tremolo devices. For example, Itoh U.S. Pat. No. 4,903,568 discloses a tremolo device for a guitar having a stabilizing plate and mounted spring to maintain an initial position of the tremolo arm.

Watson U.S. Pat. No. 3,382,749 discloses a tremolo device utilizing a single rod cylinder to inflate a diaphragm disposed on the guitar body.

Lohman U.S. Pat. No. 2,136,627 discloses a tremolo device for a guitar comprising an electric motor to impart a vibratory motion to the guitar strings.

Kusek U.S. Pat. No. 4,944,208 discloses an adjustable tremolo device for a guitar including a cam for controlling the operation of the individual strings.

Borisoff U.S. Pat. No. 4,928,564 discloses a tremolo stabilizing unit including springs for providing appropriate biasing.

Fender U.S. Pat. No. 4,724,737 discloses a tremolo unit including a rocker element and a spring for applying a bias.

Satoh U.S. Pat. No. 4,939,971 discloses a tremolo device for a guitar including a spring member to maintain the guitar bridge in an initial position.

The above-identified references, however, fail to disclose a tremolo unit for a stringed instrument having a means for isolating the tuning of each string, a means for muting the instrument without effecting the tuning thereof, a means for generating a tremolo effect by rotating the tremolo arm about an axis substantially perpendicular to the instrument face, and/or wherein the pitch of the instrument strings may be both raised and lowered relative to string pitch when the tremolo arm is at rest.

SUMMARY OF THE INVENTION

The present invention overcomes the above-discussed limitations and shortcomings of known tremolo devices and satisfies a significant need for a tremolo device for a stringed instrument which provides improved performance capabilities.

According to the present invention, there is provided a tremolo and/or vibrato control system for a stringed musical instrument comprising a tremolo arm which is connected to the instrument so as to rotate about an axis substantially perpendicular to the instrument surface; a first fluid member which provides fluid displacement in response to movement of the tremolo arm; a second fluid member which is connected to the instrument bridge and is in fluid communication with the first fluid member so as to provide and/or allow movement of the instrument bridge based upon fluid displaced in the first member; and wherein the connection between the tremolo arm and the first member is such that a change in tension of one or more of the instrument strings does not change the pitch in the other strings.

In use, the strings are first tuned while the tremolo arm is in its position at rest. Thereafter, the instrument may be played to create a tremolo effect by rotating the tremolo arm about an axis substantially perpendicular to the instrument surface. Rotating the tremolo arm in one direction raises the pitch of the strings relative to their pitch when the tremolo arm is at rest, because the tremolo arm creates fluid displacement in the first and second fluid members directed in first a direction so that the instrument bridge is pulled towards the instrument face. Rotating the tremolo arm in the other direction lowers string pitch relative to their pitch when the arm is at rest because fluid is displaced in the first and second fluid members in a second direction so that the instrument bridge is raised relative to the instrument face. A biasing member returns the tremolo arm to and maintains the tremolo arm in its original position at rest when the tremolo arm is no longer being rotated.

The present invention may additionally include a means for maintaining fluid level within the first and second fluid members.

It is an object of the present invention to provide a tremolo and/or vibrato system for a stringed musical instrument in which a change in pitch and/or tension of one string, such as when tuning or bending a string, has substantially no effect on the pitch of the remaining strings.

Another object of the present invention is to provide a tremolo system for a stringed musical instrument wherein the user may create a muted effect without effecting the pitch of the instrument strings.

Still another object of the present invention is to provide a tremolo system for a stringed musical instrument wherein a tremolo effect is generated by rotating the tremolo arm along the surface of the instrument.

It is another object of the invention to provide a tremolo system for a stringed musical instrument that requires less physical effort to activate.

Other objects, advantages and salient features of the present invention will become apparent from the following detailed description, which, when taken in conjunction with the annexed drawings, discloses preferred embodiments of the present invention.

Figure 1:
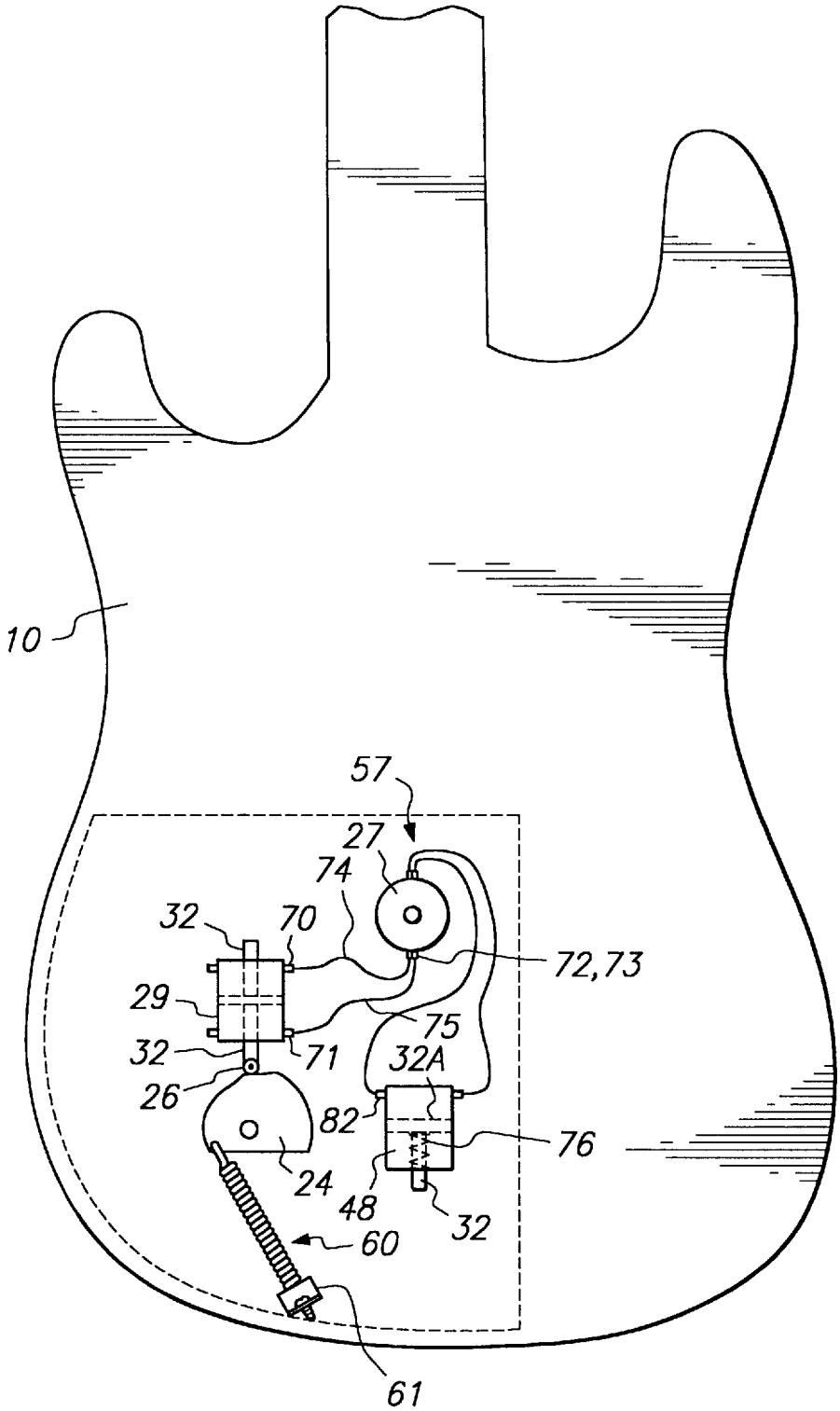
FIG. 1 is a rear plan view of a stringed musical instrument according to the preferred embodiments of the present invention.

Table 1 is a list of cross reference numbers cited in the following Detailed Description of the Preferred Embodiments section, together with the component names corresponding thereto.

DETAILED DESCRIPTION OF THE PREFERRED EMBODIMENTS

Referring to FIGS. 1–5, there is disclosed a tremolo and/or vibrato control system for a stringed musical instrument according to a preferred embodiment of the present invention, comprising instrument body 10, instrument strings 20, instrument bridge 12, bridge connecting mechanism 36, 38, and 44, tremolo arm 16, first fluid member 29, second fluid member 27, third fluid member 48, tremolo arm cam 24, cam connecting member 56, and tremolo arm biasing member 60. The fluid members and their connecting mechanisms are preferably but not necessarily mounted within instrument body 10 relative to instrument bridge 12 and tremolo arm 16 so as to be substantially hidden from view and shielded from contact and/or tampering.

Figure 2:
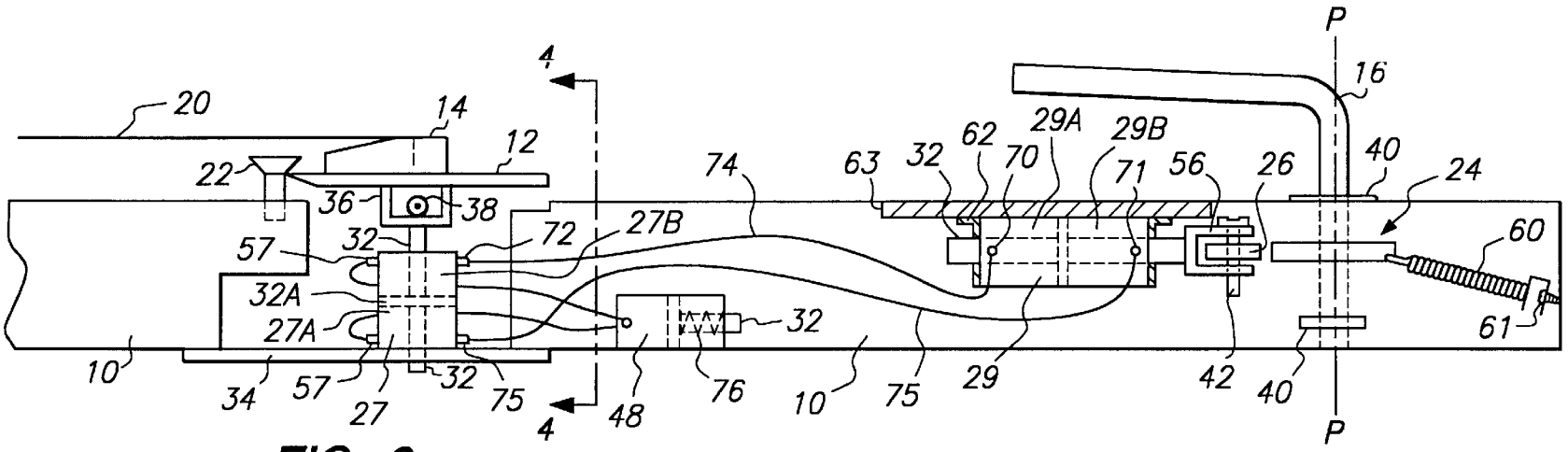
FIG. 2 is a side elevational view thereof.
Figure 7:
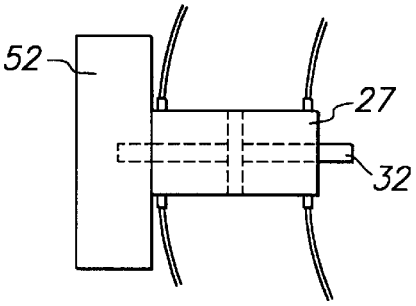
FIG. 7 is a view of a preferred embodiment of the present invention taken along the 7—7 line of FIG. 6.

According to the preferred embodiments of the present invention, the user thereof is capable of generating a tremolo effect in part by rotating tremolo arm 16 about an axis substantially perpendicular to instrument body 10. As shown in FIG. 2, tremolo arm 16 preferably rotates about perpendicular axis P. Tremolo arm 16 is mounted to instrument body 10 through bearings 40, which allow tremolo arm 16 to rotate. In this way, the musician executes a more natural hand movement when generating a tremolo effect.

Figure 8:
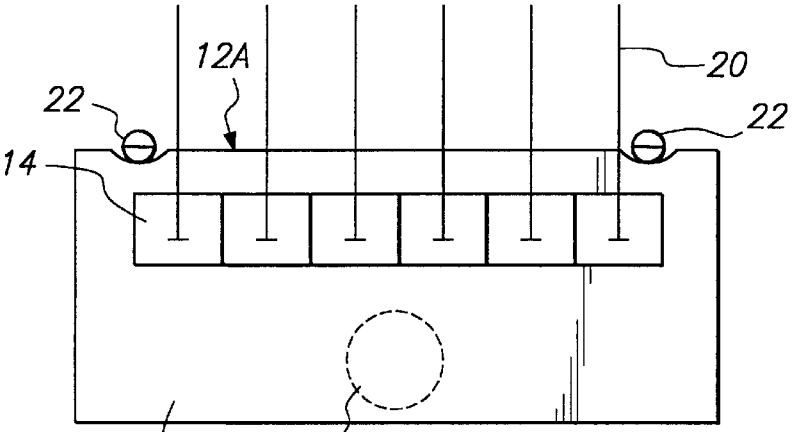
FIG. 8 is a top plan view of the bridge assembly of a preferred embodiment of the present invention.

Instrument bridge 12 is engaged with the end portions of strings 20 so as to provide tension thereto. Edge 12A (FIG. 8) of bridge 12 preferably contacts pivot posts 22 (which are mounted to instrument body 10) so that bridge 12 rotates about posts 22, with the tension of strings 20 (and hence their pitch) being dependent upon the amount of rotation of bridge 12.

The present invention preferably but not necessarily includes a means for generating a tremolo effect by imparting motion to bridge 12 relative to pivot posts 22 that is in proportion to the extent of rotation of tremolo arm 16 about axis P. The tremolo generating means preferably but not necessarily comprise a means, connected to tremolo arm 16 and bridge 12, for allowing movement of bridge 12 based upon the rotation of tremolo arm 16 so as to cause bridge 12 to rotate about pivot pins 22. The movement means preferably comprises a first fluid member 29 having piston rod 32, which is connected to tremolo arm 16.

First fluid member 29 preferably but not necessarily comprises a miniature hydraulic cylinder having non-compressible fluid therein and movable piston 32A which is connected to piston rod 32 and is slidably disposed within cylinder 29 so as to create two isolated chambers therein, each being filled with non-compressible fluid. In a preferred embodiment of the present invention, cylinder 29 is double acting, i.e., it includes ports 70 and 71 at either end thereof so that fluid is displaced by rod 32 and piston 32A moving in either direction.

The movement means preferably but not necessarily further includes second fluid member 27 having a piston rod 32 which is operably connected to bridge 12. Second fluid member 27 preferably but not necessarily comprises a miniature hydraulic cylinder having a non-compressible fluid therein and movable piston 32A which is connected to piston rod 32 and is slidably disposed within cylinder 27 so as to create two isolated chambers therein. In a preferred embodiment of the present invention, cylinder 27 is double acting, i.e., it includes ports 72 and 73 at either end thereof so that fluid is displaced by rod 32 and piston 32A moving in either direction.

Figure 5:
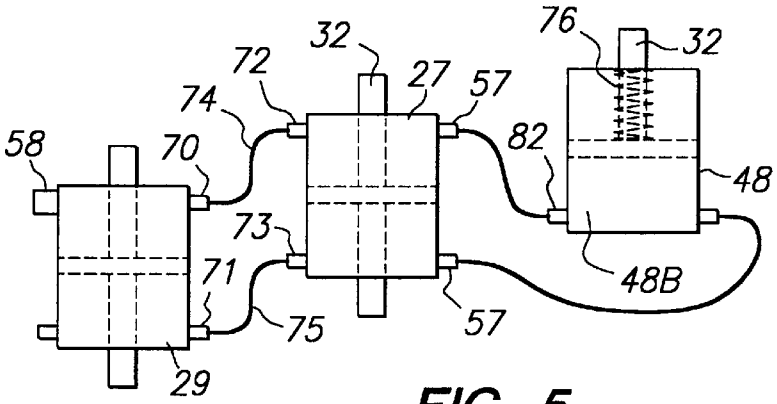
FIG. 5 is a view of a preferred embodiment of the present invention showing the fluid assembly feature thereof.

In the preferred embodiments of the present invention, fluid communication is provided between cylinder 27 and cylinder 29 so that fluid displaced in cylinder 29 due to rotation of tremolo arm 16 is applied to cylinder 27, thereby rotating bridge 12 about pivot pins 22. Referring to FIGS. 2 and 5, tubing 74 connects port 70 of cylinder 29 with port 72 of cylinder 27 so as to provide fluid communication therebetween. Similarly, tubing 75 connects port 71 of cylinder 29 with port 73 of cylinder 27 so as to provide fluid communication therebetween. In this way, fluid that is displaced in one cylinder 27 or 29 due to movement of its piston rod 32 and piston 32A will urge fluid through tubing 74, 75 and into the other cylinder so as to impart motion to piston rod 32 of the other cylinder.

For example, referring to FIG. 2, movement of rod 32 and piston 32A within cylinder 29 displaces fluid in one of chambers 29A or 29B whose volume is reduced thereby, depending on the direction of motion of rod 32. If piston rod 32 moves from right to left in FIG. 2, then fluid is displaced in chamber 29A of cylinder 29 so as to urge fluid through tubing 74 and into chamber 27B of cylinder 27. The increased volume of fluid in chamber 27B urges piston rod 32/piston 32A of cylinder 27 downwardly. This downward motion of piston rod 32 displaces fluid in chamber 27A of cylinder 27 so as to urge fluid therein into chamber 29B of cylinder 29 via tubing 75, thereby displacing the same amount of fluid on each side of cylinder pistons 32A when they are moved.

The present invention includes a means for connecting piston rod 32 of cylinder 29 to tremolo arm 16. Referring to FIGS. 1 and 2, the connecting means preferably but not necessarily comprises a means for translating rotational movement of tremolo arm 16 into linear movement of piston rod 32, including cam 24, cam follower 26, and clevis 56.

When tremolo arm 16 is at rest and strings 20 are substantially tuned, strings 20 pull bridge 12 upwardly. This upward force pulls piston rod 32 of cylinder 27 upwardly, which thereby urges piston rod 32 of cylinder 29 and cam follower 26 against cam 24. As a result, cam follower 26 substantially continuously contacts and applies pressure to cam 24 when instrument 10 is substantially tuned.

Additionally, the relationship between strings 20, bridge 12, cylinders 27 and 29, and cam 24 allows for the effective muting of the stringed instrument by placing one's hand against bridge 12. Because upward forces acting on bridge 12 due to strings 20 are substantially greater than the downward force acting on bridge 12 necessary to create a muting effect, the stringed instrument may be muted without altering string pitch.

A central portion of cam 24 is preferably connected to tremolo arm 16, as shown in FIG. 2. The outer edge of cam 24 engages with cam follower 26 so as to cooperate with piston rod 32 of cylinder 29. Cam 24 preferably has a varying diameter and/or radius so that the rotation of tremolo arm 16 translates piston 32A within cylinder 29. In this way, the exact position of piston 32A relative to cylinder 29 is dependent upon the diameter and/or radius of the portion of cam 24 which is adjacent to cam follower 26. When the portion of cam 24 having a larger diameter and/or radius contacts cam follower 26, piston rod 32 and piston 32A are substantially displaced within cylinder 29 (from right to left in FIG. 2), whereas when the portion of cam 24 having a smaller diameter and/or radius contacts cam follower 26, upward forces acting on bridge 12 due to strings 20 cause piston rod 32 and piston 32A to be displaced within cylinder 29 (from left to right in FIG. 2).

The diameter and/or radius of cam 24 is preferably but not necessarily designed so that rotation of tremolo arm 16 causes string pitch to raise or lower relative to the string pitch when tremolo arm 16 is at rest (i.e., without any tremolo effect), depending upon the direction in which tremolo arm 16 is rotated. For example, in one preferred embodiment, rotating tremolo arm 16 in the clockwise direction causes string pitch to lower relative to string pitch when tremolo arm 16 is at rest, while rotating tremolo arm 16 in the counterclockwise direction causes string pitch to raise relative to string pitch when tremolo arm 16 is at rest. In another preferred embodiment, the diameter and/or radius of cam 24 could be designed so that rotation of tremolo arm 16 in a counterclockwise direction lowers string pitch, while rotation of tremolo arm 16 in a clockwise direction raises string pitch. As a result, users of the musical instrument are provided more options to suite their individual tastes.

Figure 3:
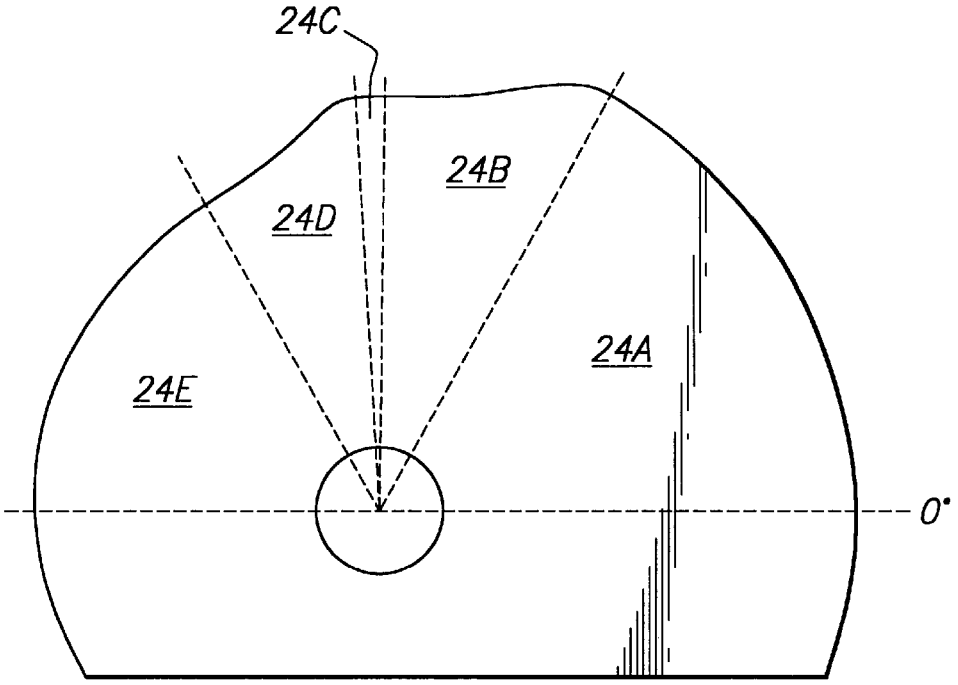
FIG. 3 is a front elevational view of a cam member of a preferred embodiment of the present invention.

Accordingly, cam 24 includes a portion 24A having an increased diameter and/or radius and another portion 24E having a decreased diameter and/or radius, relative to the cam diameter when tremolo arm 16 is at rest. Referring to FIG. 3, cam 24 is preferably but not necessarily divided into at least five sections. Alternatively, cam 24 is divided into a different number of sections.

According to a preferred embodiment of the present invention, a first portion 24A of cam 24, such as from 0° to approximately 60°, has a substantially constant first diameter and/or radius; a second portion 24B of cam 24, such as from approximately 60° to approximately 88°, preferably has a first varying diameter and/or radius; a third portion 24C of cam 24, such as from approximately 88° to approximately 92°, preferably has a second constant diameter and/or radius; a fourth portion 24D of cam 24, such as from approximately 92° to approximately 120°, preferably has a second varying diameter and/or radius; and a fifth portion 24E of cam 24, such as from approximately 120° to approximately 180°, preferably has a third constant diameter and/or radius. In this way, rotating tremolo arm 16 so that portion 24A engages with cam follower 26 raises the pitch of strings 20, while rotating tremolo arm 16 so that portion 24E engages with cam follower 26 lowers the pitch of strings 20, relative to string pitch when tremolo arm 16 is at rest.

Portion 24C of cam 24 preferably but not necessarily comprises a dwell of substantially constant radius which contacts cam follower 26 when tremolo arm 16 is at rest, i.e., when it is not being rotated. Thus the instrument is tuned while cam portion 24C engages with cam follower 26. The design of cam portion 24C is such that the force cam follower 26 exerts on cam portion 24C due to strings 20 pulling bridge 12 upwardly will not cause rotation of cam 24 in either direction when tremolo arm 16 is at rest. As a result of this non-rotational feature and as a result of cylinders 27 and 29 being filled with noncompressible fluid, varying the tension of strings 20, such as by tuning strings 20 or otherwise, does not alter the positions of cylinders 27 and 29, bridge 12 or tremolo arm 16. This nonmovement of bridge 12 thereby ensures that strings 20 can be independently tuned and that bridge 12 will be completely stable when tremolo arm 16 is at rest.

Cam portions 24B and 24D preferably provide smooth transitions between portions of cam 24 having different radii. In preferred embodiments of the present invention, the outer edge of cam portions 24B and 24D each comprise a modified sine curve. Alternatively, cam portions 24B and 24D include outer edges forming other shapes which form smooth transitions between the portions of cam 24 having different radii. By cam 24 having smooth, gradual transitions between cam portions of differing radii, less force is required to rotate tremolo arm 16.

The tremolo system preferably but not necessarily includes a means for returning tremolo arm 16 to its position at rest when it is no longer subject to manual rotation. Referring to FIGS. 1 and 2, the return means preferably comprises biasing member 60, having a first end of which is engaged with an edge of cam 24 and a second end which is engaged with the instrument body 10. In a preferred embodiment of the present invention, biasing member 60 comprises a spring, but alternatively it may suitably comprise other biasing elements. As shown, after cam 24 has been displaced in either direction due to rotation of tremolo arm 16, biasing member 60 preferably urges cam 24 in the opposite direction until cam portion 24C contacts cam follower 26.

In another preferred embodiment, a plurality of biasing members 60 are used wherein one end of each is connected to opposite ends of cam 24, such as at 0° and 180°, and a second end of each is connected to instrument body 10. In this embodiment, substantially equal and opposite forces bias cam 24 so as to position cam portion 24C adjacent cam follower 26. The presence of opposing biasing forces substantially eliminates occurrences of overdamping and/or overshooting of cam 24, i.e. wherein in returning cam 24 to its position at rest, the biasing force initially urges cam 24 beyond its position at rest due to the nature and extent of the biasing force.

Figure 4:
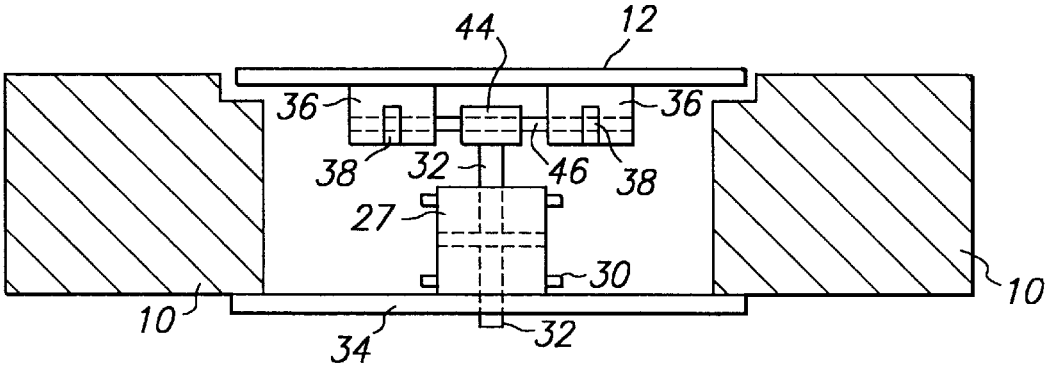
FIG. 4 is a elevational view of a preferred embodiment of the present invention taken along the 4—4 line of FIG. 2.
Figure 9:
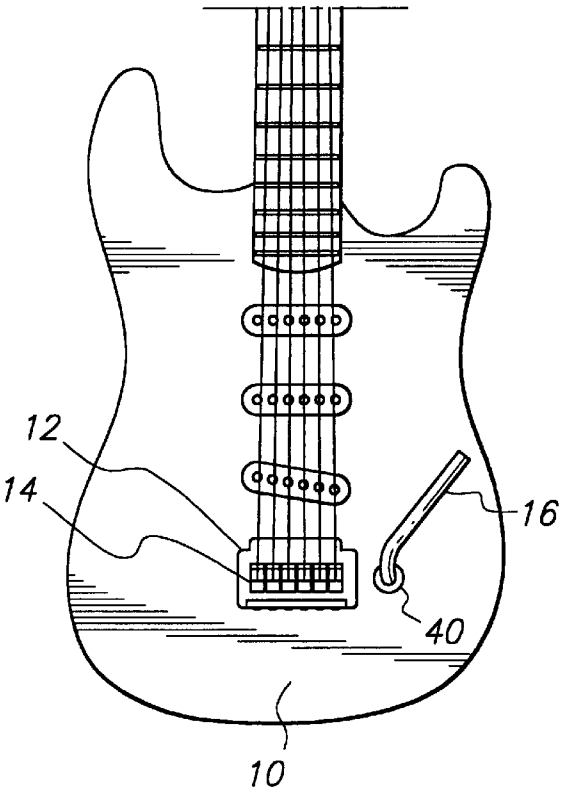
FIG. 9 is a front plan view of the preferred embodiments of the present invention embedded within a stringed instrument.

Referring to FIGS. 2 and 4, bridge 12 is connected to piston rod 32 of cylinder 27 by brackets 36, piston rod clevis 44, pin 46 and bearings/bushings 38. Brackets 36 are preferably connected to the underside of bridge 12 and include bearings/bushings 38 therein. Clevis 44 is connected to one end of piston rod 32 of cylinder 27. Pin 46 preferably extends through clevis 44 and bearings/bushings 38 of brackets 36 so that as piston 32A is raised or lowered within cylinder 27 due to rotational movement of tremolo arm 16, bridge 12 moves accordingly.

The tremolo system according to the present invention may preferably but not necessarily include a means for substantially automatically replenishing any minute amount of fluid within cylinders 27 and 29 which may have leaked therefrom over an extended period of time. As shown in FIGS. 2 and 5, the replenishing means preferably comprises a third hydraulic cylinder 48 having piston rod 32, piston 32A and return spring 76; and check valve fittings 57 associated with cylinder 27.

Replenishing cylinder 48 is preferably but not necessarily single acting, thereby having non-compressible fluid and ports 82 disposed on only one side of piston 32A. Ports 82 of cylinder 48 are preferably connected to cavities 27A and 27B of cylinder 27 as well as cavities 29A and 29B of cylinder 29 via tubing 74, 75 as shown in FIG. 2. Spring 76 is disposed within cylinder 48 and engages with piston 32A of cylinder 48 so as to urge piston 32A towards ports 82, thereby creating fluid pressure therein. The resulting fluid pressure urges fluid into cylinders 27 and 29 via nylon tubing when the fluid pressure in cylinders 27 and 29 fall beneath the fluid pressure in cylinder 48, such as when the tension of strings 20 are substantially lowered.

Cylinder 27 preferably but not necessarily includes a pair of check valve fittings 57 (FIG. 5) which allow for the passage of fluid from cylinder 48 into cylinder 27 but prevent fluid flow in the reverse direction. In this way, pressure buildup in cylinders 27 and 29 will have no effect on cylinder 48, so that the operating pressure in cylinder 48 may be at a lower pressure than the operating pressures generated in cylinders 27 and 29.

In use, rotation of tremolo arm 16 in a first direction causes cam portion 24A to contact cam follower 26. Such contact urges piston 32A of cylinder 29 to move (from right to left in FIG. 2) so as to create fluid displacement in chamber 29A of cylinder 29. The fluid displacement thereupon creates a comparable displacement in chamber 27B of cylinder 27, thereby moving piston 32A of cylinder 27 downwardly. This downward movement of piston 32A and piston rod 32 results in bridge 12 pivoting downwardly, thus increasing string pitch.

Similarly, rotation of tremolo arm 16 in a second direction causes cam portion 24E to be positioned adjacent cam follower 26. Because the radius of cam portion 24E is substantially less than the radii of the other cam portions, positioning cam portion 24E adjacent cam follower 26 allows bridge 12 to pivot upwardly away from instrument body 10 due to forces applied to bridge 12 by strings 20 which are now capable of moving piston rod 32 of cylinder 27 upwardly and piston rod 32 of cylinder 29 more towards cam 24 (via fluid displacement from cylinder chamber 27B to 29A) than if another portion of cam 24 was adjacent cam follower 26. As a result of bridge 12 being pivoted upwardly, string pitch is lowered relative to the string pitch when another portion of cam 24 is adjacent cam follower 26.

Further, because the tension of strings 20 provide an upward force on bridge 12, a fluid displacement exists in cylinders 27 and 29 so as to urge cam follower 26 into contact with cam 24. When tremolo arm 16 is not being rotated, this contact substantially prevents any movement of cylinders 27 and 29, thereby ensuring that strings 20 can be independently tuned without the tuning of one string 20 from effecting the tuning of another.

Although there have been described what are at present considered to be the preferred embodiments of the present invention, it will be understood that the invention can be embodied in other specific forms without departing from the spirit or essential characteristics thereof.

For example, it is understood that fluid members other than single and/or double acting cylinders may be used for cylinders 27 and 29. Moreover, other biasing members other than return spring 60 may be used in place thereof.

It is also understood that replenishing cylinder 48 may be directly connected to either cylinder 27 (FIG. 2) or cylinder 29 via nylon tubing in order to replenish any oil which may have leaked from the system over time.

Figure 6:
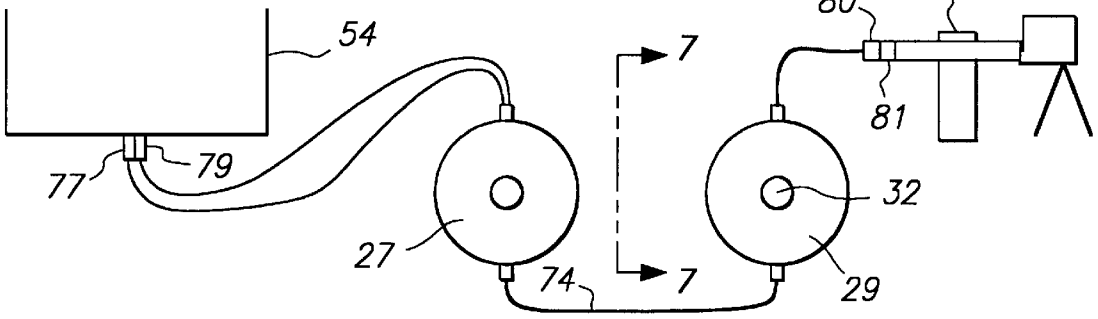
FIG. 6 is a view of a preferred embodiment of the present invention detailing an assembly thereof.

In assembling the present invention, the process for filling cylinders with non-compressible fluid, such as non-compressible oil, and removing air therefrom preferably but not necessarily comprises the steps of first placing or mounting cylinders 27 and 29 on a level surface so that its ports are aligned substantially vertically (FIG. 6). Then nylon tubing 74, 75 is connected between the lower disposed ports of cylinders 27 and 29. Nylon tubing is then connected between the upper extending ports of cylinder 27 and reservoir 54 via T-fitting 77 and valve 79, and tubing is connected between the upper extending ports of cylinder 29 and vacuum pump 78 via T-fitting 80 and valve 81. Next, with valve 79 in the closed position, vacuum pump 78 is activated so as to draw as much air from cylinders 27 and 29 as possible. Then valve 79 is opened so that the substantial vacuum in cylinders 27 and 29 draws oil therein. Any excess air is discharged from cylinders 27 and 29 by repeatingly moving piston rods 32 to and from the ends of their respective strokes. Thereafter, plugs are inserted into the upper ports of cylinder 29.

Non-compressible fluid in cylinder 48 is filled by first mounting cylinder 48 so that the upper port and lower port are substantially vertically aligned. Reservoir 54 is then connected to the lower port, and vacuum pump 78 is connected to the upper port. Next, vacuum pump 78 is activated to draw fluid from reservoir 54. Air is discharged from cylinder 48 by repeatingly moving piston rod 32 to and from the farthestmost ends of its stroke. Thereafter, piston rod 32 is substantially locked into its farthestmost position by placing a sleeve thereover. The sleeve preferably but not necessarily includes a groove which runs along one side of the sleeve so that the sleeve can be placed between cylinder 48 and a screw which is attached to the end of piston rod 32. This locking feature prevents spring 76 from discharging fluid from cylinder 48. Cylinder 48 can then be connected to the upper ports of cylinder 27, thus forming fluid communication between cylinder 48 and cylinders 27 and 29. After connecting cylinder 48 to cylinder 27, the sleeve is removed.

The described embodiments are, therefore, to be considered in all aspects as illustrative, and not restrictive. The scope of the invention is indicated by the appended claims rather than the foregoing descriptions.

TABLE 1

| | |
|---|---|
| 10 Musical Instrument Body | 48 Fluid Cylinder |
| 12 Musical Instrument Bridge | 54 Fluid Reservoir |
| 12A Bridge Pivot Edge | 56 Cam Follower Clevis |
| 16 Tremolo Arm | 57 Check Valve Fittings |
| 20 Musical Instrument Strings | 60 Cam Return Spring |
| 22 Bridge Pivot Posts | 70 Cylinder 29 Port |
| 24 Cam | 71 Cylinder 29 Port |
| 24A–E Cam Portions | 72 Cylinder 27 Port |
| 26 Cam Follower | 73 Cylinder 27 Port |
| 27 Fluid Cylinder | 74 Nylon Tubing |
| 29 Fluid Cylinder | 75 Nylon Tubing |
| 32 Cylinder Piston Rod | 76 Cylinder Return Spring |
| 32A Cylinder Piston | 77 Reservoir T-Fitting |
| 36 Instrument Bridge Bracket | 78 Vacuum Pump |
| 38 Bushings | 79 Reservoir Valve |
| 40 Tremolo Arm Bearings | 80 Vacuum Pump T-Fitting |
| 44 Bridge Clevis | 81 Vacuum Pump Valve |
| 46 Bridge Clevis Pin | 82 Cylinder 48 Port |

I claim:

1. A tremolo device for a stringed musical instrument, comprising:

an arm member connected to the instrument;

first fluid means, operatively connected to said arm member, for moving a bridge of the instrument in response to rotation of said arm member so as to change a pitch of a tone generated by the instrument; and means for rotating said arm member relative to the instrument so that rotation of said arm member in a first direction substantially raises a pitch of a tone generated by the instrument, and rotating said arm member in a second direction substantially lowers the pitch of a tone generated by the instrument.

2. A tremolo device as recited in claim 1, wherein:

said rotating means allows for rotation of said arm member about an axis substantially perpendicular to a surface of the instrument; and wherein said rotating means comprises bearings disposed between said arm member and the instrument.

3. A tremolo device as recited in claim 1, wherein:

said rotating means includes a means for substantially preventing a tone generated by a first string of the instrument from changing based upon a change in tension of a second string thereof.

4. A tremolo device as recited in claim 3, wherein:

said rotating means comprises a cam member connected to said arm member so as to rotate therewith, said cam member having an outer edge which engages with said first fluid means;

said cam member having a first portion and a second portion whose radius is greater than a radius of said first portion; and said tone change preventing means comprises a third portion of said outer edge of said cam member disposed between said first portion and said second portion thereof, said third portion having a curvature of substantially constant radius, and said third portion engages with said first fluid means when said arm member is at rest.

5. A tremolo device as recited in claim 4, further including:

means for biasing said cam member so that said third portion of said outer edge thereof engages with said first fluid means when said arm member is not being rotated.

6. A tremolo device as recited in claim 4, wherein:

a portion of said cam member between said first portion and said third portion has an edge forming a modified sine curve; and a portion of said cam member between said second portion and said third portion has an edge forming a modified sine curve.

7. A tremolo device as recited in claim 4, wherein:

said first portion of said cam member has a radius which is less than said radius of said third portion; and said second portion of said cam member has a radius which is greater than said radius of said third portion.

8. A tremolo device as recited in claim 1, wherein:

said rotating means comprises a cam member connected to said arm member so as to rotate therewith, said cam member having an outer edge which engages with said first fluid means; and said outer edge of said cam member including a first portion and a second portion having a radius greater than said first portion.

9. A tremolo device as recited in claim 1, further including:

a second fluid means, connected to a bridge of the instrument and in fluid communication with said first fluid means, for transferring fluid displacement from said first fluid means into movement of the instrument bridge so as to change tone pitch.

10. A tremolo device as recited in claim 9, wherein:

said first fluid means and said second fluid means each comprise a fluid cylinder having a piston and piston rod movably disposed therein;

said outer edge of said cam member engages with said piston rod of said fluid cylinder of said first fluid means; and movement of a piston rod of one of said fluid cylinders causes movement of a piston rod of the other of said fluid cylinders.

11. A tremolo device as recited in claim 10, wherein:

said fluid cylinders are double acting.

12. A tremolo device as recited in claim 9, further including:

means for substantially maintaining fluid in said first fluid means and said second fluid means.

13. A tremolo device as recited in claim 12, wherein:

said fluid maintaining means comprises a single acting fluid cylinder in fluid communication with said first fluid means and said second fluid means, having a means for applying a fluid under pressure to said first fluid means and said second fluid means, and valve means for controlling fluid flow between said first and said second fluid means and said single acting fluid cylinder.

14. A tremolo device as recited in claim 9, wherein:

the instrument bridge pivots about a first axis; and said first fluid means pivots the instrument bridge about said first axis in response to rotation of said arm member.

15. A vibrato device for a stringed instrument having a body member, a plurality of strings, and a bridge member which is pivotally attached to the body member comprising:

a tremolo arm;

means, operatively connected to said tremolo arm and said bridge member, for modulating said bridge member relative to said body member in response to movement by said tremolo arm so as to substantially generate a vibrato effect;

wherein said modulating means comprises a first means for translating rotational movement of said tremolo arm into linear movement and a second means, connected between said first means and said bridge member, for moving said bridge member in response to movement of said first means; and said second means comprises a first fluid member which is engaged with said tremolo arm so that movement of said tremolo arm creates a fluid displacement therein, and a second fluid member which is engaged with said bridge member and is in fluid communication with said first fluid member so as to impart movement on said bridge member in response to said fluid displacement in said first fluid member.

16. A vibrato device for a stringed instrument as recited in claim 15, wherein:

said first fluid member and said second fluid member each comprise a fluid cylinder; and said stringed instrument further includes a third fluid member comprising a fluid cylinder, for substantially maintaining fluid in said fluid cylinders of said first fluid member and said second fluid member.

17. A vibrato device for a stringed instrument having a body member, a plurality of strings, and a bridge member which is pivotally attached to the body member, comprising:

a tremolo arm;

means, operatively connected to said tremolo arm and said bridge member, for modulating said bridge member relative to said body member in response to movement by said tremolo arm so as to substantially generate a vibrato effect;

wherein said modulating means comprises a first means for translating rotational movement of said tremolo arm into linear movement, and a second means, connected between said first means and said bridge member, for moving said bridge member in response to movement of said first means; and said first means includes a cam member attached to said tremolo arm having an outer edge which operatively engages with said second means, said cam member having a first portion and a second portion and wherein said first portion has a greater radius than said second portion.

18. A vibrato device for a stringed instrument as recited in claim 17, wherein:

a third portion of said cam member has a substantially constant radius, and said third edge portion engages with said second means when said tremolo arm is at rest and substantially resists movement of said cam member from a change in tension of said string members.

19. A process for creating a stringed musical instrument having a system for generating a tremolo effect, comprising the steps of:

obtaining a first fluid member;

obtaining a second fluid member;

obtaining a stringed musical instrument having a bridge which is pivotal about an axis;

obtaining a cam member;

obtaining an arm member;

attaching said cam member to said arm member;

rotatably attaching said arm member to said instrument so that said cam member is disposed therewithin;

filling said first fluid member and said second fluid member with substantially noncompressible fluid, comprising the steps of connecting a reservoir of noncompressible fluid to one of said first or second fluid members, providing fluid communication between said first and said second fluid members, connecting a pump to one of said first or said second fluid members which is not connected to said fluid reservoir, activating said pump so as to draw air from said fluid members, allowing fluid to flow into said first and said second fluid members while said pump is activated, disconnecting said first fluid member and said second fluid member from said fluid reservoir and said pump, and placing a plurality of plugs onto ports of said first and said second fluid members so as to prevent noncompressible fluid from spilling therefrom; and mounting said first and said second fluid members within said instrument body so that said first member is operatively engaged with said cam member and said second fluid member is operatively engaged with said bridge of said instrument.

20. A tremolo device for a stringed musical instrument, comprising:

an arm member rotatably connected to the instrument;

a first fluid member;

a means for connecting said arm member to said first fluid member so that rotational movement of said arm member displaces fluid in said first fluid member; and wherein said first fluid member is connected to a bridge of the stringed musical instrument such that fluid displacement in said first fluid member rotates the instrument bridge about an axis.

21. A tremolo device as recited in claim 20, further including:

a second fluid member in fluid communication with said first fluid member and connected between said first fluid member and the instrument bridge.

22. A tremolo device as recited in claim 21, further including:

at least one bracket member connected to the bridge;

at least one bearing member operably engaged with said bracket member; and wherein said second fluid member is connected to said bearing member.

23. A tremolo device as recited in claim 21, further including:

a means for replenishing fluid in said first fluid member and said second fluid member.

24. A tremolo device as recited in claim 20, wherein:

said connecting means comprises a cam member connected to said arm member so as to rotate therewith, said cam member having an outer edge which is engaged with said first fluid member.

25. A tremolo device as recited in claim 24, wherein:

said cam member includes a first cam portion, a second cam portion and a third cam portion, wherein said first cam portion has a radius which is greater that a radius of said second cam portion;

said third cam portion is positioned between said first cam portion and said second cam portion and includes a radius which is substantially constant; and said third cam portion is engaged with said first fluid member when said arm member is at rest.

26. A tremolo device as recited in claim 25, wherein:

an edge between said cam portions forms a modified sine curve.

27. A vibrato device for a stringed instrument having a body member, a plurality of string, and a bridge member which is pivotally attached to the body member, comprising:

a tremolo arm;

means, operatively connected to said tremolo arm and said bridge member, for modulating said bridge member relative to said body member in response to movement by said tremolo arm so as to substantially generate a vibrato effect;

wherein said modulating means comprises a first means for translating rotational movement of said tremolo arm into linear movement, and a second means, connected between said first means and said bridge member, for moving said bridge member in response to movement of said first means; and said second means comprises a first fluid member connected between said first means and said bridge member, said first fluid member being engaged with said tremolo arm so that movement of said tremolo arm creates a fluid displacement therein.

28. A vibrato device for a stringed instrument having a body member, a plurality of strings, and a bridge member which is pivotally attached to the body member, comprising:

a tremolo arm;

means, operatively connected to said tremolo arm and said bridge member, for modulating said bridge member relative to said body member in response to movement by said tremolo arm so as to substantially generate a vibrato effect;

wherein said modulating means comprises a first means for translating rotational movement of said tremolo arm into linear movement, and a second means, connected between said first means and said bridge member, for moving said bridge member in response to movement of said first means; and said modulating means comprises a cam member connected to said tremolo arm so that rotation of said tremolo arm causes rotation of said cam member.

29. A vibrato device for a stringed musical instrument having a body member, a plurality of strings, and a bridge member which is pivotally attached to the body member, comprising:

a tremolo arm;

means, operatively connected between said tremolo arm and said bridge member, for modulating said bridge member relative to said body member in response to movement of said tremolo arm so as to substantially generate a vibrato effect;

wherein said modulating means comprises a means for translating rotational movement of said tremolo arm into rotational movement of said bridge member in response to movement of said tremolo arm; and said modulating means includes a cam member connected to said tremolo arm, wherein rotation of said tremolo arm causes rotation of said cam member.

* * * * *